US005249587A

United States Patent [19]

Luckado

[11] Patent Number: 5,249,587

[45] Date of Patent: Oct. 5, 1993

[54] GEAR TRANSMISSION FOR PRINTER DIE IN CIGARETTE MAKING MACHINE

[75] Inventor: Marshall C. Luckado, Richmond, Va.

[73] Assignee: Philip Morris Incorporated, New York, N.Y.

[21] Appl. No.: 823,698

[22] Filed: Jan. 21, 1992

[51] Int. Cl.[5] ..... A24C 5/38; A24C 5/60

[52] U.S. Cl. ..... 131/284; 131/84.1

[58] Field of Search ..... 131/284, 84.1; 101/216, 101/223, 230; 226/38, 48, 49, 51

[56] References Cited

U.S. PATENT DOCUMENTS

| | | | |
|---|---|---|---|
| 933,239 | 9/1909 | Drucklieb et al. | 131/284 |
| 1,042,652 | 10/1912 | Cazen | 131/284 |
| 1,090,889 | 3/1914 | Smith | 131/284 |
| 2,324,486 | 7/1943 | Clausen | 131/284 |
| 3,915,176 | 10/1975 | Heitmann et al. | 131/66 R |
| 4,345,709 | 8/1982 | Barton | 226/195 |
| 4,463,766 | 8/1984 | Arthur et al. | 131/84 R |
| 4,567,752 | 2/1986 | Labbe | 73/37.6 |
| 4,898,187 | 2/1990 | Hinchcliffe et al. | 131/284 |
| 4,913,329 | 4/1990 | Cahill et al. | 226/97 |

FOREIGN PATENT DOCUMENTS 2100192 12/1982 United Kingdom .

*Primary Examiner*—V. Millin
*Assistant Examiner*—William M. Pierce
*Attorney, Agent, or Firm*—Ronald A. Krasnow; Brenda J. Panichi

[57] ABSTRACT

In the printer section of a cigarette making machine, pivotable gear train is provided between a printer die gear and an input gear to change the rotation characteristics of the printer die gear with respect to the input gear. The gear train has different idler gears that can each mesh with the printer die gear to change the direction of rotation of the printer die gear and change the rotational speed of the printer die gear without changing the speed or direction of the input gear.

14 Claims, 6 Drawing Sheets

GEAR TRANSMISSION FOR PRINTER DIE IN CIGARETTE MAKING MACHINE

BACKGROUND OF THE INVENTION

This invention relates to a method and apparatus for changing the gearing in the printer section of a cigarette rod making machine. More specifically, this invention relates to a method and apparatus to facilitate rotating the printer die in the printer section of a cigarette rod making machine in either a clockwise or counter-clockwise direction without disassembling the printer gearing.

Most cigarette making machines include a printer for applying a brand name or other indicia to cigarette paper at regular intervals so that when cigarettes are made, the printing will appear at the same location on each cigarette. The cigarette paper is conventionally a paper web that starts on a supply roll and is fed through a conventional splice unit to a paper reservoir. From the reservoir, the cigarette paper is fed through the printer to the garniture and then on to the part of the making machine that wraps and seals the paper around a tobacco rod.

During its passage through the printer, the cigarette paper is threaded though a number of rollers and guide plates. The cigarette paper is typically pulled through the printer by one or more of these rollers. The rollers that pull the cigarette paper through the printer are driven by a linkage to the main motor of the cigarette making machine. The rollers that are not driven are typically free spinning and rotate only when the cigarette paper contacts them. Two rollers in the printer that are typically driven are the printer die roller and the drag roller. These two rollers are linked to the main motor of the cigarette making machine by a series of gears in the gear box of the printer.

The desired brand name or other indicia is typically embossed on the printer die. Printing is accomplished by employing a pressure contact between a printer die and an adjacent roller sometimes called the compression roller, such that when the paper passes between the printer die and the compression roller, the desired indicia embossed on the printer die is printed on the paper.

Conventionally, the same cigarette making machine is used to make several different brands of cigarettes. This requires a change-over from one printer die to another that has different embossing. It also sometimes requires changing the gearing used to drive the printer die. For example, different ratio gearing may be necessary to drive the printer die at a different speed than the drag roller for different cigarette lengths. Also, different brands may have printing on different sides of the cigarette paper. This change-over requires that the direction of rotation of the printer die (and corresponding paper threading) be changed. For example, some cigarette brands have only an identification number or symbol printed on the inside of the cigarette paper, which is not visible to the consumer. In a later process, tipping paper including the brand name or other indicia visible to the consumer is added to the cigarette.

Currently, to change-over the gear train linking the printer die to the main motor, an operator must disassemble the gear train, change the gearing in the gear train, and then reassemble the gear train. Disassembly causes substantial down time in the cigarette making process while an employee manually disassembles the making machine's printer gear box, taking forty-five minutes or longer. Also, such manual disassembly risks mismatching oil-laden gear box parts during reassembly. Currently, change-over is very costly in terms of both labor and lost cigarette production capacity.

This invention greatly reduces the time it takes to change over the printer in a cigarette making machine. The invention provides a pivotable gear train in the printer gear box between gear connected to the printer die and gear connected to the main motor of the cigarette making machine, called the input gear. With the pivotable gear train, disassembly of the gear train in the printer gear box is no longer necessary.

SUMMARY OF THE INVENTION

This invention greatly reduces the time and effort required to change-over the printer of a cigarette making machine to accommodate production of different brands of cigarettes.

Thus, it is an object of this invention to provide a method and apparatus to quickly reverse the rotational direction of the printer die so that different indicia can be printed, on either side of the cigarette paper, using the same printer section in the same cigarette making machine.

It also an object of this invention to provide a method and apparatus to allow for printing indicia at different intervals on the cigarette paper, depending on the specified length of the cigarette in production, using the same printer section in the same cigarette making machine.

It is another object of this invention to avoid the necessity of manual disassembly and reassembly of a printer gear train, a time-consuming job in which oil laden gear box parts may be mismatched or outside debris may be introduced into the gear box.

These and other objects are met by a pivotable gear train interconnecting the printer die gear and an input gear. The printer die gear is connected to the printer die by a common axis. Thus, when the rotation of the printer die gear changes, so does the rotation of the printer die roller. Similarly, the input gear is linked to the cigarette machine's main motor and to the gear train of the present invention so that when the main motor is on, the input gear, the gears in the gear train and the printer die gear all rotate.

The pivotable gear train has at least two idler gears that rotate in different directions as the input gear rotates from the main motor. The gear train pivots allowing at least two different idler gears from the train to mesh with the printer die gear. Thus, the printer die gear will rotate in different directions depending upon which idler gear is meshed.

To change-over the rotation of the printer die gear, a printer rear door is opened, exposing the pivotable gear train. By pivoting the gear arms that support the gears in the train about two pivot points, the configuration of the gear train can be changed. The arms are then secured to prevent pivoting while the cigarette making machine is in operation. The printer rear door is then closed.

In alternative embodiments, the different idler gears in the gear train can have the same or different pitch diameters or number of teeth, creating a variety of possible gear ratios. Thus, alternative embodiments of this invention include the use of idler gears with different pitch diameters or numbers of teeth to rotate the printer die gear at different speeds.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION

This invention relates to the quick change-over of a printer in a cigarette making machine to accommodate different brands by enabling printing on different sides and at different intervals of cigarette paper. This detailed description of the preferred embodiment will refer continually to the printer section of a cigarette making machine, but it will be understood by one of skill in the art that this invention could be employed in different machines that have different printing requirements. Specifically, machines that do not necessarily make cigarettes, but print brand names or other indicia on a continuous paper web at specific intervals, could also use this invention with the same benefits described above.

Figure 1:
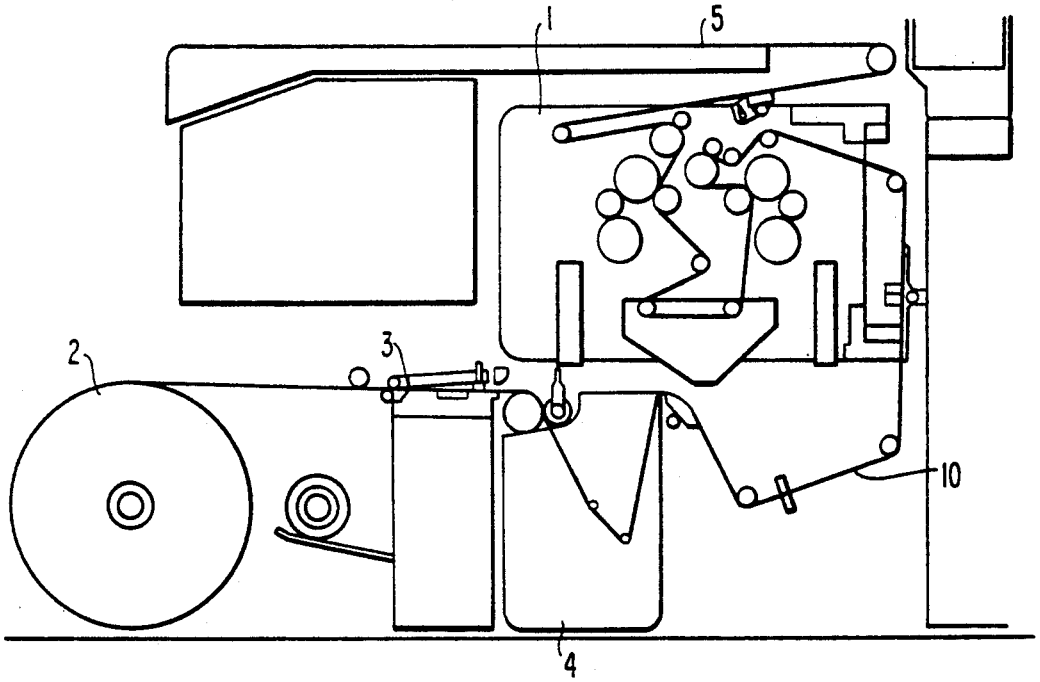
FIG. 1 is a diagrammatic view of the paper path and printer of a cigarette making machine.

FIG. 1 shows a typical cigarette paper path and printer section 1 of a cigarette making machine. The cigarette paper 10 is fed from a supply roll 2 through a conventional splice unit 3 to a paper reservoir 4. From the reservoir 4, the cigarette paper 10 is fed through the printer section 1 to the garniture 5 and then on to the part of the making machine that wraps and seals the paper around a tobacco rod. The paper can be fed through the printer section 1 in any manner known to those skilled in the art.

Figure 2:
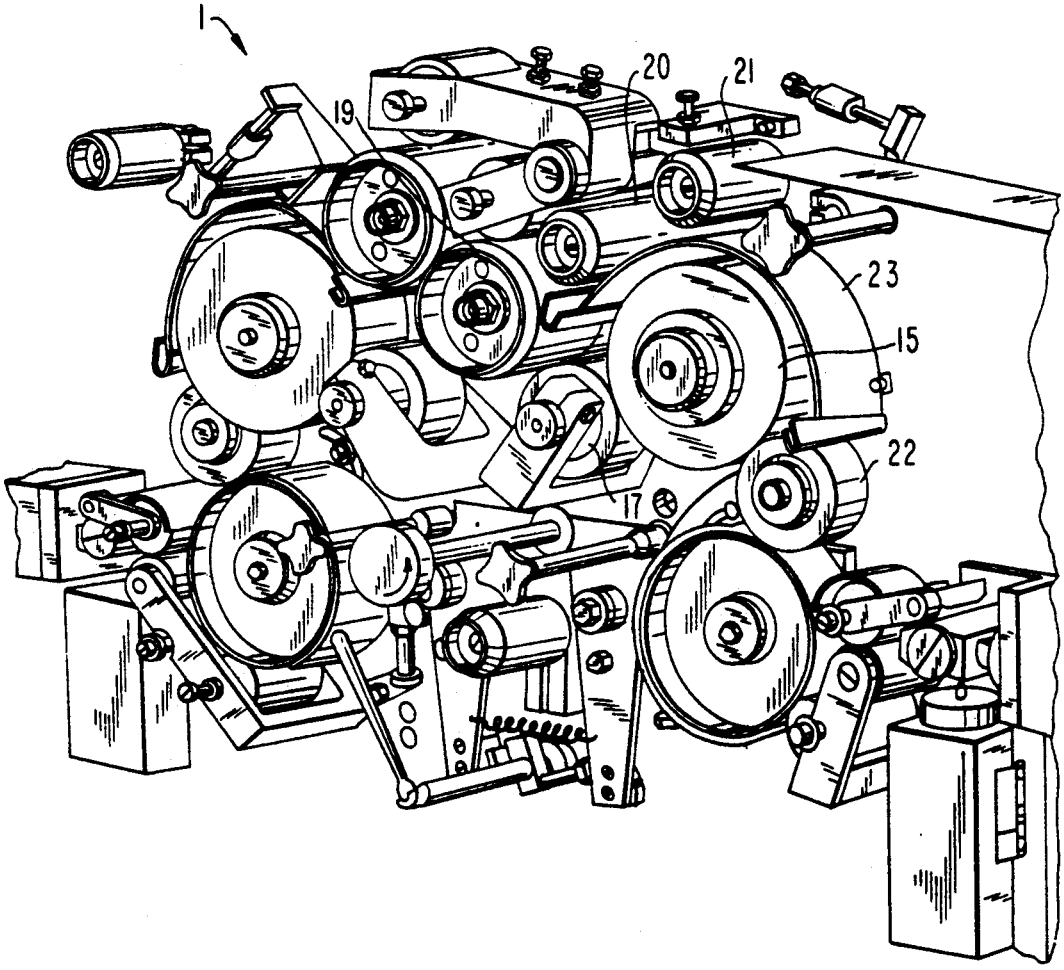
FIG. 2 is a perspective view of the front of the printer of a cigarette making machine.

The printer section 1 is shown in more detail in FIG. 2, without cigarette paper threaded through it. There is shown a printer die 15 in contact with a compression roller 17. Also shown is a drag roller 19. Within the printer section 1, typically the drag roller 19 and the printer die 15 are driven by a series of gears from the main drive motor of the cigarette making machine. The transfer roller 22 is driven by inking roller 24 below transfer roller 22. Transfer roller 22 picks up ink from inking roller 24 and transfers it to the printer die 15. The other rollers 20 and 21 shown in FIG. 2 rotate freely. These rollers 20 and 21 allow for various printer functions and adjustments, such as guiding the paper. The printer of any cigarette rod making machine can have one or more printer dies and corresponding compression rollers and drag rollers. Additional printer dies allow for different colors of ink or different indicia to be printed on the same longitudinal section of cigarette paper. It will be understood by one of skill in the art that this invention is useful for any number of printer dies in a printer.

Figure 3:
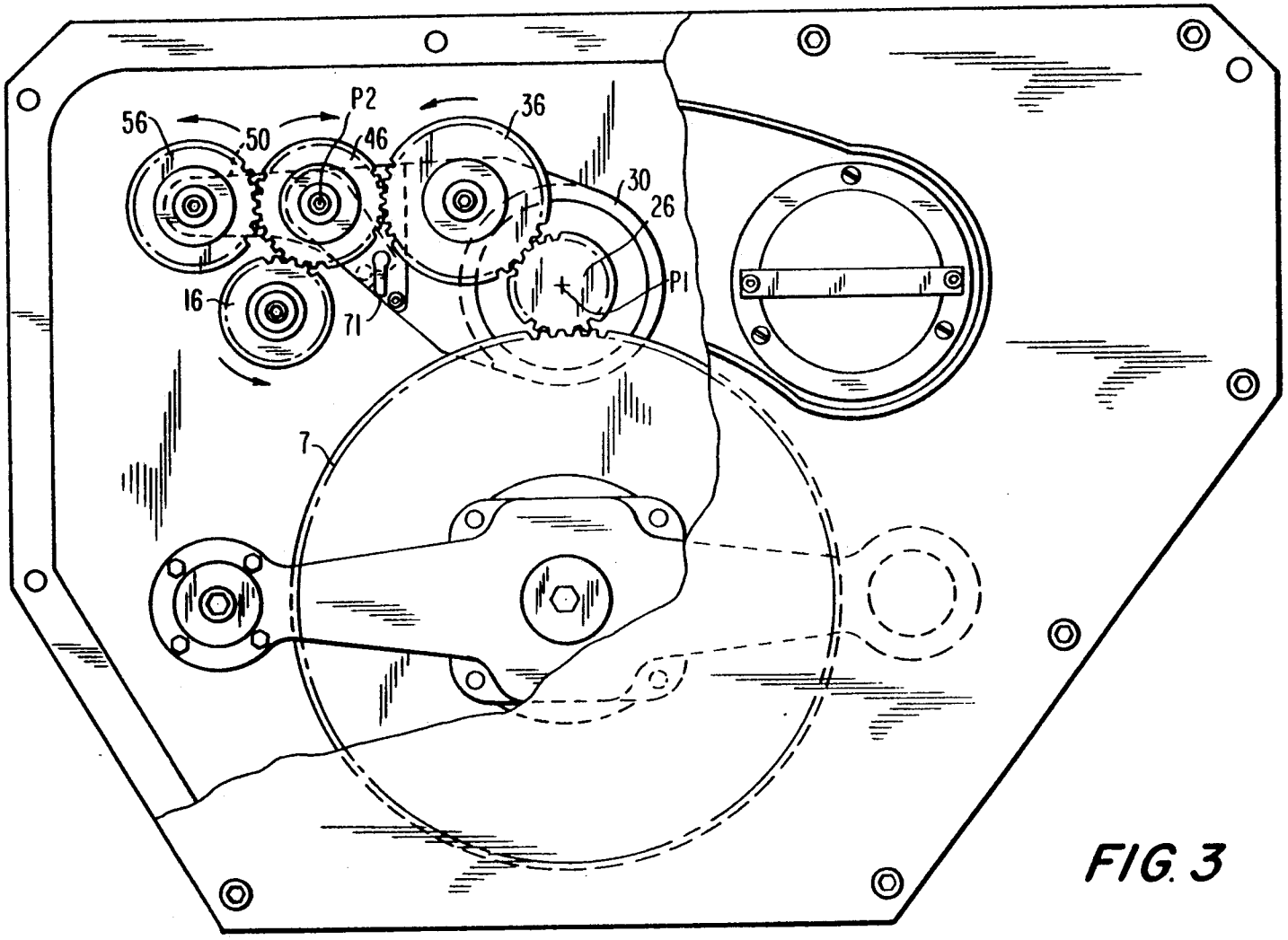
FIG. 3 is an elevational view of the rear of the printer section, with part of the rear printer door broken away, showing this invention in one configuration with one idler gear meshed with the printer die gear.

FIG. 3 shows an elevational view of the back of the printer, with the rear printer door cut away, exposing the pivotable gear train of this invention. In a preferred embodiment, the input gear 26 is rotated by the main motor 7 of the cigarette making machine. The input gear 26 is also meshed with the pivotable gear train. Specifically, the input gear 26 is meshed with the first idler gear 36. In turn, first idler gear 36 is meshed with second idler gear 46, which is meshed with a third idler gear 56. Therefore, when input gear 26 rotates, the first, second and third idler gears will rotate. The printer die gear 16 also rotates when the input gear 26 rotates, but in a direction dependant upon which idler gear is meshed. It will be understood that each of the gears described herein is of a type known to those of skill in the art. The shaft arrangement of the pivotable quick-change gear train is preferably parallel and the tooth form is preferably spur or helical. In the most preferred embodiment, each of the second and third idler gears 46 and 56 are identical. Typically, each may have 60 teeth, a diametrical pitch of 30, a pitch diameter of 2.00, and outside diameter of 2.067 inches, an inside diameter of 1.259 inches and a pressure angle of 20°, such that each are identically interchangeable when meshed with printer die gear 16. In the most preferred embodiment, the first idler gear 36 is larger than the second and third idler gears 46 and 56. Most preferably, the first idler gear 36 has 75 teeth, a diametrical pitch of 30, a pressure angle of 20°, a pitch diameter of 2.5 inches, an outside diameter of 2.567 inches and an inside diameter of 1.259 inches.

FIG. 3 shows one configuration of the pivotable gear train with the second idler gear 46 meshed with printer die gear 16. In this configuration, pivotable third idler gear 56 is meshed only with the second idler gear 46 and rotates without affecting the rotation of any of the printer rollers. Depending on the number of teeth or pitch diameter of second idler gear 46, in the configuration shown, the gear train may cause the printer die gear 16 to rotate at different speeds, depending on the desired printing operation.

Figure 4:
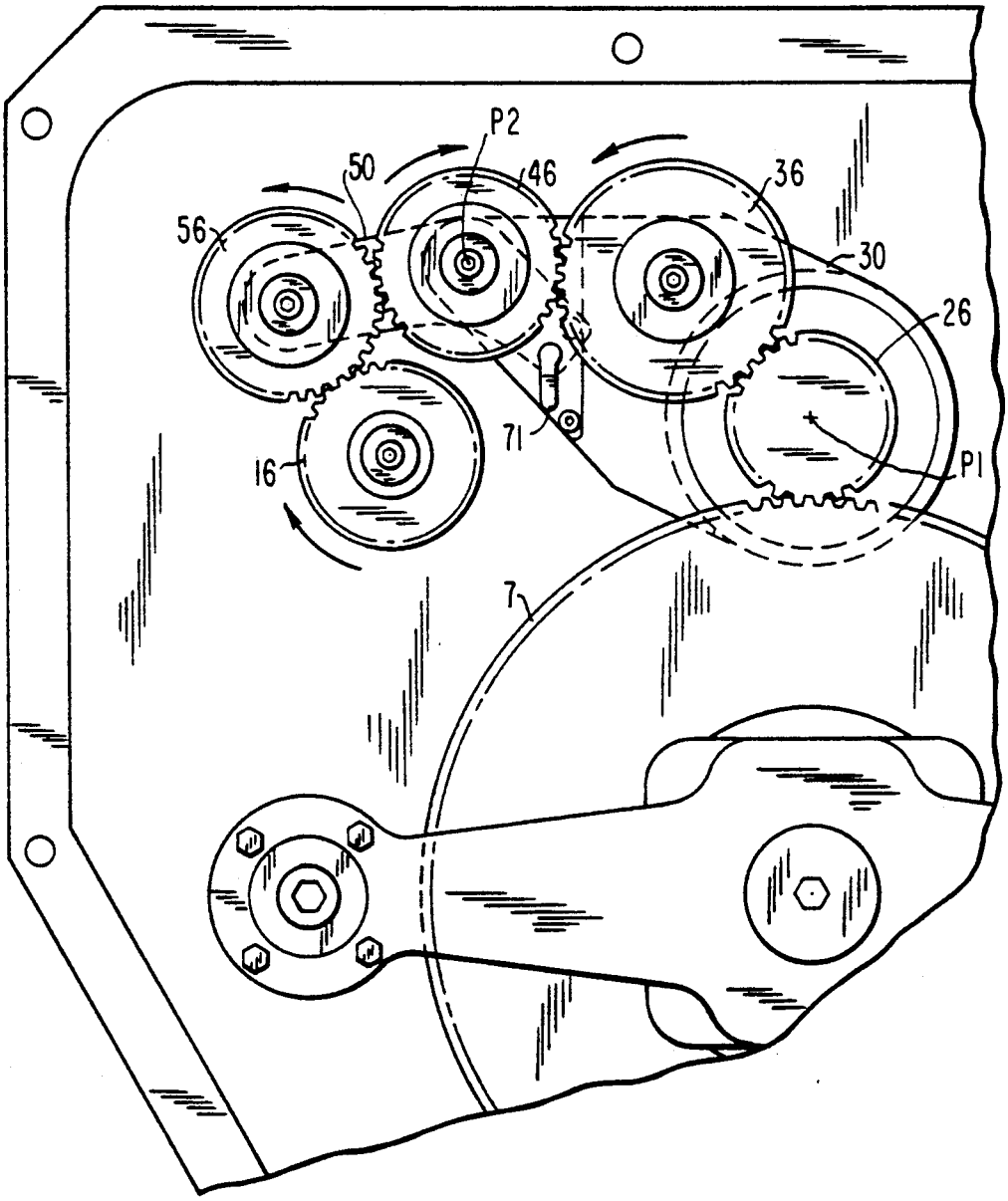
FIG. 4 is an elevational view of the rear of the printer section showing this invention in a second configuration, after the gear train has been pivoted from the configuration in FIG. 3, with a different idler gear meshed with the printer die gear.

FIG. 4 shows an alternative configuration for the pivotable gear train. In this configuration, the gear train has been pivoted so that the third idler gear 56 is meshed with printer die gear 16. Thus, in this configuration, the third idler gear 56 drives printer die gear 16. This causes the printer die gear 16 to rotate in the direction opposite to that shown in FIG. 3, as indicated by the directional arrows. Printer die gear 16 may be driven at a varying speeds by changing the number or teeth or the pitch diameter of third idler gear 56.

Figure 5:
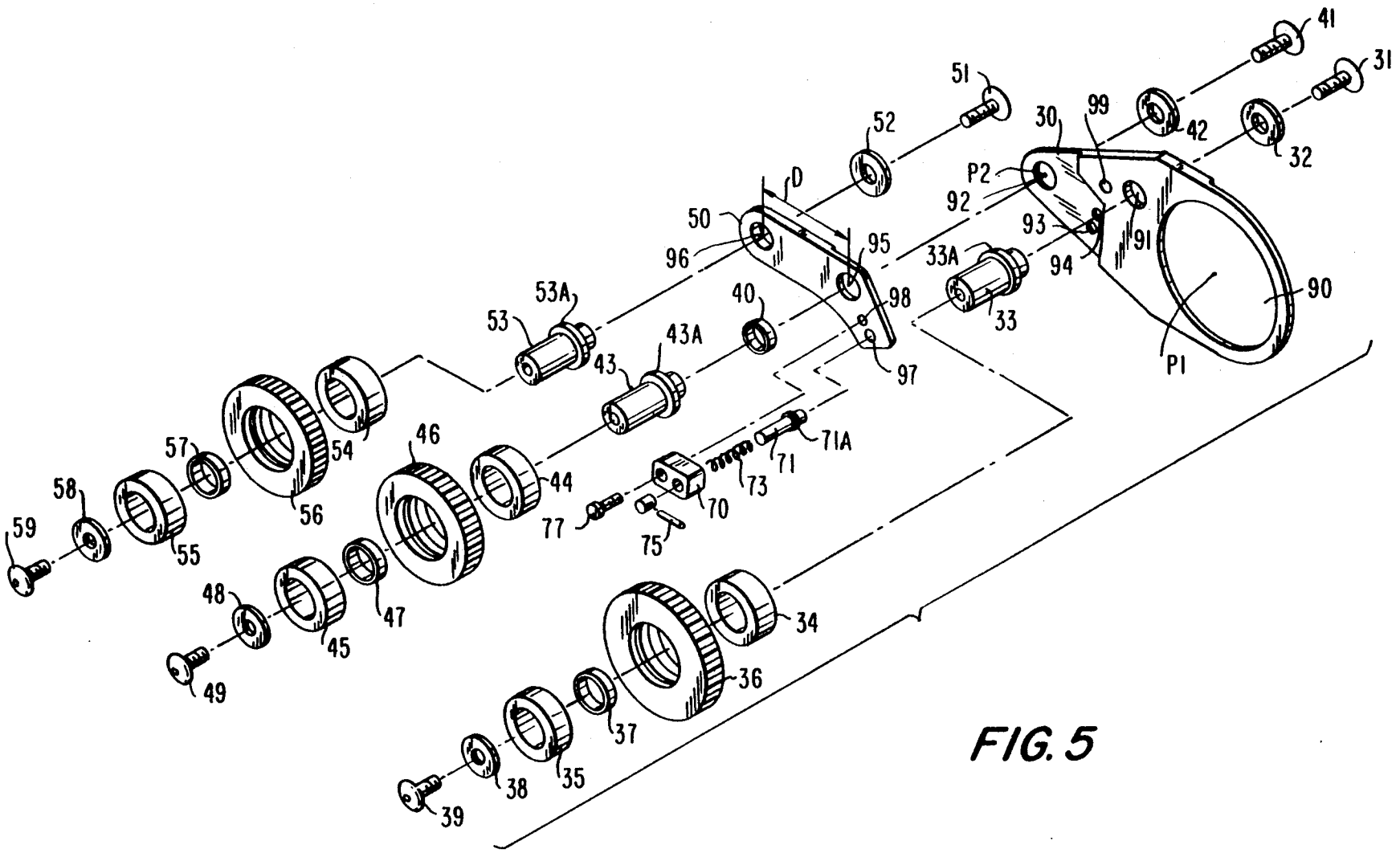
FIG. 5 is an exploded view of the quick-change gear train of this invention.

The preferred gear train includes both a quick-change gear arm 30 and a quick-change pivot arm 50, shown in FIG. 5. The gear arm 30 and pivot arm 50 shown are preferably plates, with parallel faces, machined from any suitable material known by those skilled in the art to be appropriate for such gear support and housing applications. For example, 1018 CRS carbon steel may be appropriate.

As shown in FIGS. 3 and 4, either second idler gear 46 or third idler gear 56 can be meshed with printer die gear 16 while still operating in the area between the input gear 26 and the printer die gear 16. Preferably, there are two pivot points in the pivotable gear system whereby the configuration of the gear train can be changed. The first pivot point, identified as P1, is located where the quick-change gear arm 30 pivots about the axis of rotation of the input gear 26. The second pivot point, identified as P2, is located where quick-change gear arm 30 is attached to the quick-change pivot arm 50. To change the configuration of the gear train shown in FIG. 3 to the configuration shown in FIG. 4, the quick-change gear arm 30 is pivoted about P1 and the quick-change pivot arm 50 is pivoted about P2.

Figure 6:
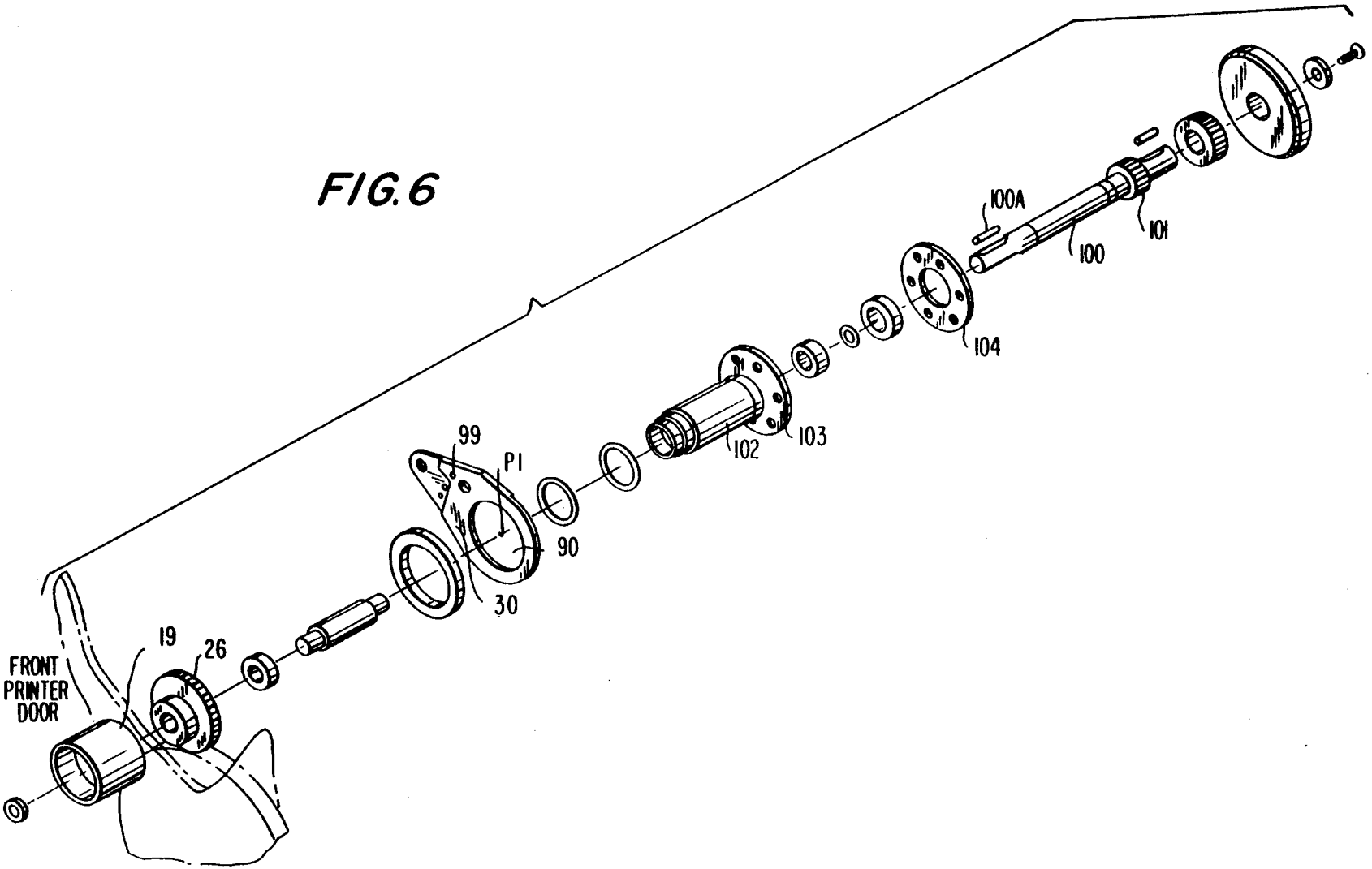
FIG. 6 is an exploded view of the drive mechanism from the main motor that drives the input gear and the drag roller and the connection from the drive mechanism to this invention.

FIG. 6 is an exploded view of the drive mechanism inside the printer gear box. It shows the quick-change gear arm 30 of this invention as part of the drive mechanism. The drive shaft 100 is linked to the main motor of the cigarette making machine by the drive plate 101. The input gear 26 that drives the gear train of this invention is mounted on shaft 100 by a locking pin 100A so that when the drive shaft 100 rotates, the input gear 26 rotates without slipping. The drive shaft 100 extends through a housing 102 having a shoulder flange 103.

FIG. 6 shows the quick-change gear arm 30, which pivots about the rotational axis P1 using a first pivot means. The first pivot means comprises a pivot bore 90 in the quick-change gear arm 30, with an axis perpendicular to the face of the quick-change gear arm 30. The pivot bore 90 fits on the shoulder flange 103 such that the quick-change gear arm 30 can pivot. There is also a plate 104 to pivotally secure the quick-change gear arm 30 on the shoulder flange 103. The quick-change gear arm 30 pivots about the rotational axis P1 of the input gear 26. The pivot axis P1 also corresponds to the axis of the gear shaft 100, the housing 102 and the axis of the pivot bore 90. Pivoting of the quick-change gear arm 30 about the axis P1 is important to allow proper meshing of gears.

The quick-change gear arm 30 should be secured against pivoting during the operation of the cigarette machine. An adjustable securing means secures the quick-change gear arm at desired orientations. Once the entire gear train is meshed in the desired orientation, the rear printer door is closed and the quick-change gear arm 30 is locked into place by causing a bolt to enter locking bore 99 in the quick-change gear arm 30, shown in FIG. 6. The locking bore 99 has an axis that is perpendicular to the face of the quick-change gear arm 30.

As shown in FIG. 5, the quick-change gear arm 30 is also provided with a first gear arm bore 91 and a second gear arm bore 92, each having an axis perpendicular to the face of the gear arm 30. First gear arm bore 91 receives first stud 33, thereby supporting first idler gear 36. Second gear arm bore 92 receives second stud 43, thereby supporting second idler gear 46.

First stud 33 may have varying diameters at different points along its length, according to the needs of the gearing system. In the preferred gearing system shown, first stud 33 has a ring 33A of enlarged diameter protruding from its midsection. The ring 33A directly abuts the front face of the quick-change gear arm 30, as its diameter is larger than the bore diameter of the first gear arm bore 91. This enlarged diameter ring 33A secures the longitudinal positioning of the first stud 33 with respect to the quick-change gear arm 30. First idler gear 36 is supported on first stud 33 by bearings 34 and 35 on either side of the inside diameter of first idler gear 36, with the bearings being separated by spacer 37. The longitudinal positioning of the gear, bearings and spacer are held by securing means such as screws 31 and 39 and washers 32 and 38.

Similarly, the quick-change gear arm 30 has a second gear arm bore 92 into which second stud 43 is perpendicularly received. Second stud 43 supports second idler gear 46 in a plane parallel to a face of quick-change gear arm 30.

Additionally, the quick-change gear arm 30 is provided with first and second gear arm receiver bores 93 and 94 that receive and secure the spring-loaded pull pin 71. Spring-loaded pull pin 71 positions the quick-change pivot arm 50 in relation to the quick-change gear arm 30. When spring-loaded pull pin 71 is fitted within first gear arm receiver bore 93, the printer die gear 16 is driven by third idler gear 56, as shown in FIG. 4. When spring-loaded pull pin 71 is fitted within second gear arm receiver bore 94, the printer die gear is driven by idler gear 46, as shown in FIG. 3. While there are only two gear arm receiver bores 93 and 94 shown in FIG. 5, it is possible to provide additional receiver bores to receive and secure the spring-loaded pull pin 71, thereby providing additional configurations for the gear train.

Quick-change pivot arm 50 may be pivoted in relation to quick-change gear arm 30 using a second pivot means. The second pivot means comprises the second stud 43, first and second gear arm receiver bores 93 and 94, and the pull pin 71. Second stud 43 is of sufficient length to be received through a first pivot arm bore 95 in the quick-change pivot arm 50 and a second gear arm bore 92 in quick-change gear arm 30. Pivot bushing 40 is inserted between the first pivot arm bore 95 and the second stud 43. Thus, quick-change pivot arm 50 pivots with respect to quick-change gear arm 30 about the longitudinal axis of second stud 43. Similarly, second idler gear 46 rotates about the longitudinal axis of second stud 43.

In the preferred gearing system, second stud 43 has a ring 43A of enlarged diameter protruding from its midsection. The ring 43A directly contacts the front face of the quick-change pivot arm 50, as its diameter is larger than the diameter of first pivot arm bore 95. The ring 43A secures the longitudinal positioning of the second stud 43 with respect to the quick-change pivot arm 50 and the quick-change gear arm 30.

The design of the second stud 43 may change according to the number of different idler gears that are present on the pivot arm. For example, the second stud 43 may be spring loaded to allow an attendant to pull the pivot arm 50 away from gear arm 30, thereby disengaging the idler gears attached to the pivot arm 50 from the gears attached to other parts of the machine. In such an embodiment, the pivot arm 50 may then rotate to allow other idler gears previously disengaged from the other gearing in the train to mesh with such other gearing.

Second stud 43 also supports second idler gear 46 in a plane parallel to the face of quick-change pivot arm 50. Second idler gear 46 is supported by bearings 44 and 45 on either side of the inside diameter of second idler gear 46, with the bearings being separated by spacer 47. The longitudinal positioning of the gear, bearings, spacer and pivot bushing 40 are held by securing means such as respective screws 41 and 49 and washers 42 and 48.

Third stud 53 is received into a second pivot arm bore 96 that lies on the end of the quick-change pivot arm 50 opposite from the first pivot arm bore 95. Third stud 53 has a diametrically enlarged ring 53A near its midsection similar to first and second studs 33 and 43. The ring 53A contacts the front face of the quick-change pivot arm 50, as its diameter is larger than diameter of the second pivot arm bore 96. The enlarged ring 53A secures the longitudinal positioning of the third stud 53 with respect to the quick-change pivot arm 50. Third stud 53 also supports third idler gear 56 in a plane parallel to the faces of quick-change pivot arm 50. Third idler gear 56 is supported by bearings 54 and 55 on either side of the inside diameter of third idler gear 56, with the bearings being separated by spacer 57. The longitudinal positioning of the gear, bearings and spacer are held by securing means such as respective screws 51 and 59 and washers 52 and 58.

In order to change the meshing configuration of the gear train of the present invention, third idler gear 56 is pivotable about the rotational axis of second idler gear 46. Third idler gear 56 pivots about the rotational axis of second idler gear 46 at a distance D between the centers of the first and second pivot arm bores 95 and 96, which support second and third idler gears, respectively. The gear train shown in FIGS. 3 and 4 has two orientations for the pivot of third idler gear 56 about this path. These two orientations correspond to the locations of first and second gear arm receiver bores 93 and 94 described above. However, it should be appreciated that any number of different orientations are possible by providing quick-change pivot arm 50 with additional gear arm receiver bores.

The quick-change pivot arm 50 has two additional bores 97 and 98 located on the pivot arm 50. Preferably, the location of these additional bores 97,98 on the quick-change pivot arm 50 is at the end of quick-change pivot arm 50 opposite to second pivot arm bore 96. A spring block 70 is rigidly attached to the quick-change pivot arm 50 by means of a screw 77 into a first of these additional bores, third pivot arm bore 98. A pull pin 71 is spring loaded through pull pin bore 97. A first end of pull pin 71 extends through pull pin bore 97 to the quick-change pivot arm 50 and is received into either first or second gear arm receiver bore 93 or 94. The length of the pull pin 71 is sufficient to extend through the thickness of the quick-change pivot arm 50 into one of the receiver bores 93 or 94 of gear arm 30 to position and secure the orientation of the pivot arm 50 with respect to the gear arm 30. This is important to prevent undesirable pivoting during operation of the cigarette making machine.

The pull pin 71 has a diametrically enlarged ring 71A similar to the other studs described above in the preferred gearing system. The enlarged ring 71A contacts the front face of the quick-change pivot arm 50 and secures the longitudinal positioning of the pull pin 71 in one of the gear arm receiver bores 93 and 94. A dowel pin 75 near the end of the pull pin 71 protrudes from the spring block 70 allowing a machine operator to pull the pull pin 71 out of one gear arm receiver bore 93 or 94, pivot the pivot arm, and then engage the pull pin 71 in another gear arm receiver bore not previously engaged.

A spring 73 encircles the neck of pull pin 71, and is compressed from its point of contact with the pull pin enlarged ring 71A to its point of contact with the rear surface of the spring block 70. The spring compression is adapted to allow the pull pin 71 to be manually released from and repositioned in the receiver bores 93 and 94 of quick-change gear arm 30. Spring block 70, like quick-change gear arm 30 and quick-change pivot arm 50, may be made from any material like hard carbon steel, or others known by those skilled in the art to be appropriate for such gear support and housing applications.

When pull pin 71 is in the position shown in FIG. 3, the printer die gear 16 is meshed with second idler gear 46. Preferably, second idler gear 46 is rotating in a preferably clockwise direction as shown in FIG. 3, and therefore the printer die gear 16 rotates in a counter-clockwise direction.

Alternatively, pull pin 71 may be moved to the position shown in FIG. 4. Third idler gear 56 is pivoted about the axis of second idler gear 46 and is meshed with the printer die gear 16, disengaging second idler gear 46 from the printer die gear 16. In addition to the pivot of the third idler gear, there is a corresponding pivot of the gear arm about the rotational axis P1 of the input gear 26. Preferably, second idler gear 46 is rotating in a clockwise direction, as shown in FIG. 4, so that third idler gear 56 rotates in a counter-clockwise direction and the printer die gear 16 rotates in a clockwise direction. The reversal in the printer die's rotational direction (along with corresponding rethreading of the cigarette paper through the printer) causes the opposite side of the cigarette paper to face the printer die, and thus be printed.

A machine operator may easily change the configuration of the gear train of the present invention. The operator opens the rear printer door, exposing the printer gearing and releases a bolt from the locking bore 99 in the quick-change gear arm 30 to allow the gear arm to pivot. It may also be necessary to loosen the plate 104 securing the quick-change gear arm 30 on the shoulder flange 103 to allow the gear arm to pivot. The operator pivots the gear arm 30 until the desired idler gear on the gear train is meshed with the printer die gear 16. The operator then secures the quick-change gear arm 30 with the bolt and locking bore 99 and closes the printer door.

A machine operator may also easily change the pull pin 71 position shown in FIG. 3 to the pin position shown in FIG. 4. The operator uses dowel pin 75 to withdraw the pull pin 71 out of one gear arm receiver bore 93 or 94. This action increases the compression in spring 73. The operator pivots the pivot arm 50 until the pull pin 71 aligns with the desired gear arm receiver bore 93 or 94, and then releases the pull pin 71. The force exerted by the compressed spring 73 pushes the end of the pull pin into the desired receiver bore 93 or 94.

It will be understood by one of skill in the art that this detailed description of the preferred embodiment can be changed without departing from the scope and spirit of the invention. Further, it will be understood that the above description is merely illustrative of the principles of the inventions disclosed herein.

What is claimed is:

1. An apparatus for selectively changing the rotation characteristic of a printer die gear with respect to a power input gear, said apparatus being in a gear box of a printer of a cigarette making machine, said apparatus comprising:

a gear arm pivotable mounted about an axis of rotation of said input gear, and a first pivot means to pivot said gear arm with respect to said input gear, a first idler gear supported on said gear arm, said first idler gear being meshed with said input gear, a pivot arm pivotable connected to said gear arm, and a second pivot means to pivot said pivot arm with respect to said gear arm, a second idler gear supported on said pivot arm, said second idler gear being meshed with said first idler gear, a third idler gear supported on said pivot arm, said third idler gear being meshed with said second idler gear, whereby said gear arm pivots with respect to said input gear and said pivot arm pivots with respect to said gear arm such that either said second idler gear or said third idler gear meshes with said printer die gear.

2. The apparatus of claim 1 wherein said gear arm and said pivot arm are positioned such that said input gear drives said first idler gear, said first idler gear drives said second idler gear, and said second idler gear drives said printer die gear, whereby said printer die gear rotates in the same direction as said first idler gear.

3. The apparatus of claim 1 wherein said gear arm and said pivot arm are positioned such that said input gear drives said first idler gear, said first idler gear drives said second idler gear, said second idler gear drives said third idler gear and said third idler gear drives said printer die gear, whereby said printer die gear rotates in the direction opposite to said first idler gear.

4. The apparatus of claim 1 further comprising:

said gear arm provided with a pivot bore, a first gear arm bore and a second gear arm bore, said pivot bore being located near one end of said gear arm and having an axis that is perpendicular to a face of said gear arm, said first gear arm bore being located near the middle of said gear arm and having an axis that is perpendicular to said face of said gear arm, and said second gear arm bore being located near another end of said gear arm, and having an axis that is perpendicular to said face of said gear arm, a first stud supporting said first idler gear on said gear arm and being received into said first gear arm bore, a second stud supporting said second idler gear, said second stud being received into said second gear arm, and said first pivot means comprises said pivot bore to pivot said gear arm about said axis of said input gear, and said second pivot means comprises said second stud about which said pivot arm pivots.

5. The apparatus of claim 4 wherein said pivot arm is provided with a first pivot arm bore for receiving said second stud supporting said second idler gear and a second pivot arm bore for receiving a third stud supporting said third idler gear, said first pivot arm bore being located near an end of said pivot arm and having an axis perpendicular to a face of said pivot arm, and said second pivot arm bore being located on said pivot arm away from said first pivot arm bore and having an axis perpendicular to said face of said pivot arm.

6. The apparatus of claim 1 wherein said first pivot means comprises said gear arm provided with a pivot bore located near one end of said gear arm, said pivot bore having an axis that is perpendicular to a face of said gear arm, and a housing having a shoulder flange with a long axis that is the same as said axis of said pivot bore, said pivot bore fitting said shoulder flange thereby allowing said gear arm to pivot.

7. The apparatus of claim 6 wherein said first pivot means further comprises an adjustable securing means for securing said gear arm after said gear arm has pivoted to a desired position.

8. The apparatus of claim 1 wherein said second pivot means comprises:

said gear arm provided with a gear arm bore, said gear arm bore being located near an end of said gear arm and having an axis that is perpendicular to a face of said gear arm, a second stud received into said gear arm bore, and said pivot arm provided with a pivot arm bore, said pivot arm bore being located near an end of said pivot arm and having an axis perpendicular to a face of said pivot arm, said pivot arm bore also receiving said second stud, whereby said face of said gear arm lies along a parallel plane with said face of said pivot arm allowing said pivot arm to pivot with respect to said gear arm about said second stud.

9. The apparatus of claim 8 wherein said second pivot means further comprises:

said pivot arm provided with a pull pin bore said pull in bore being located on said pivot arm away from said pivot arm bore and having an axis perpendicular to said face of said pivot arm, said gear arm provided with one or more receiver bores, said receiver bores having centers on circles concentric to the axis of said second stud, and located on said gear arm away from said gear arm bore, and a pull pin, whereby when said pull pin is received through said pull pin bore and through one of said receiver bores, said pivot arm becomes secured from pivoting.

10. The apparatus of claim 1 wherein said second idler gear and said third idler gear are identical.

11. A method for selectively changing the rotation characteristic of a printer die gear with respect to a power input gear, said method being in a gear box of a printer of a cigarette making machine, said method comprising the steps of:

meshing a pivotable gear train between said printer die gear and said input gear, wherein said gear train has two or more idler gears, each of said idler gears being capable of meshing with said printer die gear, and pivoting said gear train with respect to said input gear, and selecting an idler gear from said two or more idler gears within said gear train to mesh with said printer die gear.

12. The method of claim 11 wherein when said gear train is pivoted, said gear train is pivoted about at least two parallel axes.

13. The method of claim 12 wherein pivoting said gear train comprises first pivoting a gear arm about an axis of rotation for said input gear with a pivot bore in said gear arm, and then pivoting a pivot arm about an axis of rotation of one of the gears in said gear train, whereby before pivoting a first idler gear within said gear train meshes with said die gear and after such pivot a second idler gear within said gear train meshes with said printer die gear while said first idler gear does not mesh with said printer die gear.

14. The method of claim 13 wherein said pivoting of said gear train is adjustable using a pull pin that secures said gear arm to said pivot arm at selected orientations and a bolt that secures said gear arm to a door of said printer at selected orientations.

* * * * *